United States Patent [19]

Sorko-Ram

[11] Patent Number: 4,864,317

[45] Date of Patent: Sep. 5, 1989

[54] COMBINATION SATELLITE ANTENNA-SOLAR COLLECTOR

[76] Inventor: Paul O. Sorko-Ram, 1111 N. Centerville, Sturgis, Mich. 49091

[21] Appl. No.: 464,234

[22] Filed: Feb. 7, 1983

[51] Int. Cl.[4] ..... H01Q 3/12

[52] U.S. Cl. ..... 343/720; 343/761; 126/438

[58] Field of Search ..... 343/720, 761, 839, 840; 126/438, 439

[56] References Cited

U.S. PATENT DOCUMENTS 1,932,469 10/1933 Leib et al. ..... 343/839

3,594,803 7/1971 Pucillo ..... 343/720

3,988,736 10/1976 Smith et al. ..... 343/761

4,355,630 10/1982 Fattor ..... 126/425

4,462,034 7/1984 Betsudan et al. ..... 343/761

*Primary Examiner*—William L. Sikes

*Assistant Examiner*—Michael C. Wimer

*Attorney, Agent, or Firm*—Krass & Young

[57] ABSTRACT

The same reflector dish is used to reflect solar energy to a solar collector device and electromagnetic energy in the form of satellite communications to a transducer. Thus, the apparatus can be used as a combination solar energy collector and an antenna for receiving satellite communications.

11 Claims, 2 Drawing Sheets

COMBINATION SATELLITE ANTENNA-SOLAR COLLECTOR

DESCRIPTION

1. Technical Field

This invention relates to solar energy collectors and to antennas for receiving satellite communications.

2. Background Art

The technical literature is filled with various constructions for antennas designed to receive satellite communications. In general, they comprise a dish for reflecting electromagnetic energy to a focal point at which a feed horn/low noise amplifier (LNA) assembly is located. A coaxial cable carries the signals from the LNA to a receiver which demodulates the high frequency input signal and through a series of steps translates the radio frequency (RF) signal down to base band video and audio. The output of the receiver is then connected through suitable modulation circuits to a television for viewing.

An equally wide number of different designs have been disclosed in the prior art for collecting solar energy. Many of these designs employ a dish for tracking the sun and concentrating the solar energy to a collector located at the focal point. U.S. Pat. No. 4,252,107 is a representative example of solar energy concentrators of this type and U.S. Pat. No. 3,945,015 discloses a typical example of a satellite antenna. However, by no means is this list all inclusive.

While satellite antennas and solar concentrators have some components in common, their respective arts have progressed along separate lines. The concentration of large amounts of solar energy is indeed beneficial to solar collecting devices but may be detrimental to the electronic components of a telecommunication antenna. In fact, some of those skilled in the art took great pains to design their antenna reflectors so as to minimize the concentration of solar energy. For example, U.S. Pat. No. 3,249,947 discloses an especially designed coating for the dish for refracting incident solar rays into a random distribution so that they would not be concentrated.

SUMMARY OF THE INVENTION

The present invention departs from conventional thinking of the skilled practitioners in these diverse art areas and advantageously employs the same reflector dish as part of a construction that may be used as both a solar collector and a telecommunication antenna. In general, the present invention teaches the positioning of a solar energy collector and an electromagnetic transducer at predefined locations for receiving solar energy and electromagnetic energy, respectively, reflected from the same dish.

In the preferred embodiment, means are provided for selectively moving the solar collector and transducer to a predefined area of concentrated waves reflected from the dish. In one embodiment, the collector and transducer are mounted in the front of the dish and are movable to the focal point depending upon whether the construction is to be used as a solar collector or satellite antenna. In another embodiment, a subreflector is positioned at the focal point and reflects the waves back through an opening in the center of the dish. The collector and transducer are mounted in the back of the dish, each being selectively movable into alignment with the opening. This latter approach has the advantage in that the electromagnetic wave transducer is shielded by the dish when not in use.

BRIEF DESCRIPTION OF THE DRAWINGS

These and other advantages of the present invention will become apparent to one skilled in the art upon reading the following specification and by reference to the drawings in which.

DESCRIPTION OF THE PREFERRED EMBODIMENTS

The present invention employs a disk 10 for gathering and reflecting both solar energy and electromagnetic energy. The electromagnetic energy is transmitted from telecommunication satellites in the form of radio frequency waves. Present day telecommunication satellites such as SATCOM, WESTAR and the like generally transmit microwaves in the 3.7–4.2 gigahertz (GHz) range, although other frequency ranges can be used. Since these signals have relatively low power levels, the capture area of the dish should be relatively large. Dish diameters in the two foot–twelve foot range should prove to be acceptable. The inner or concave surface of dish 10 is coated with a reflective material 12. Surface 12 may be made of a variety of materials capable of obtaining a controlled configuration in order to optimize the gain of the device when it is used as an antenna.

Figure 1:
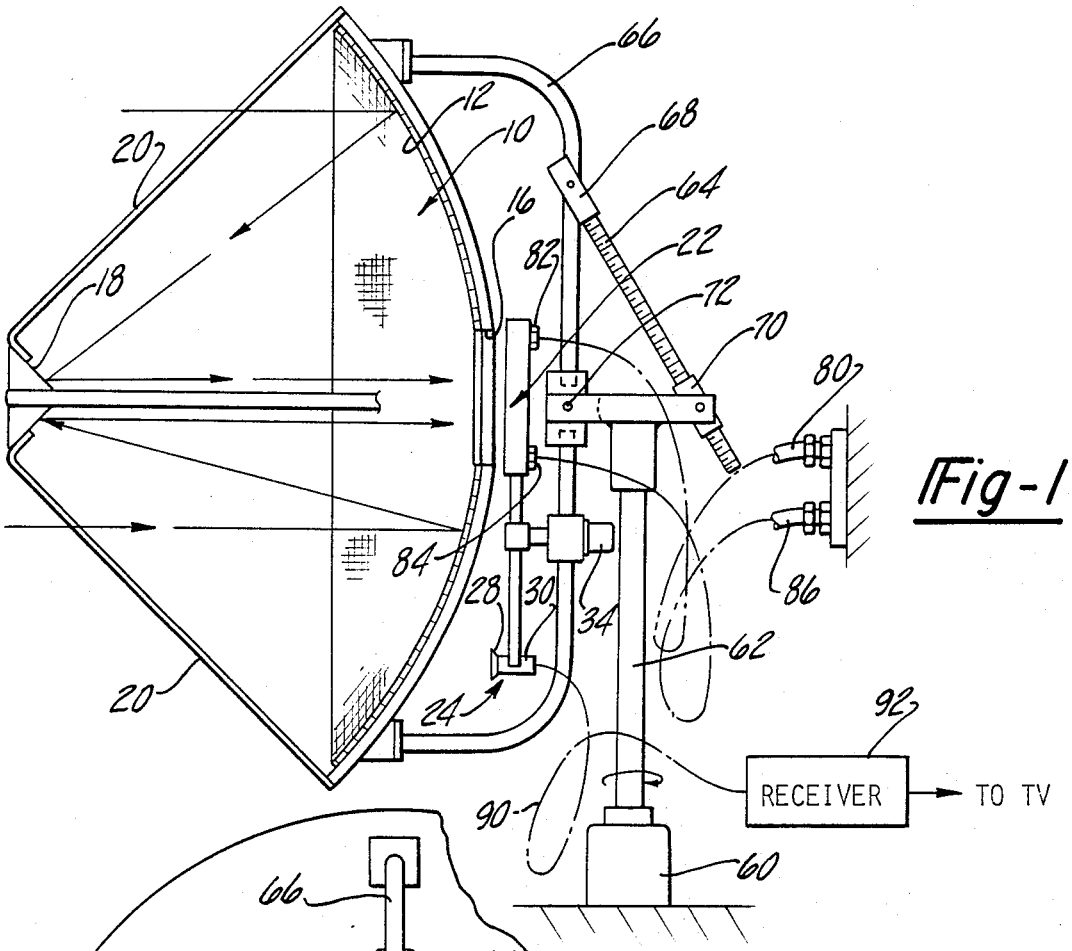
FIG. 1 is a side view of one embodiment of the present invention.
Figure 2:
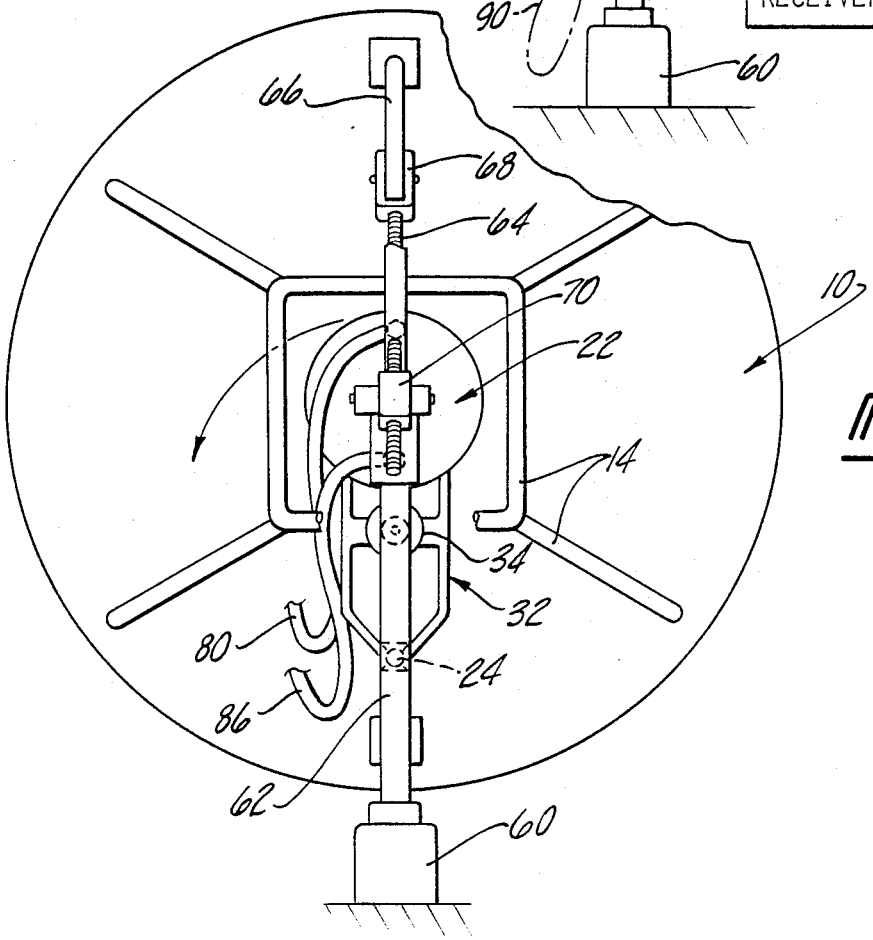
FIG. 2 is an end view thereof.
Figure 3:
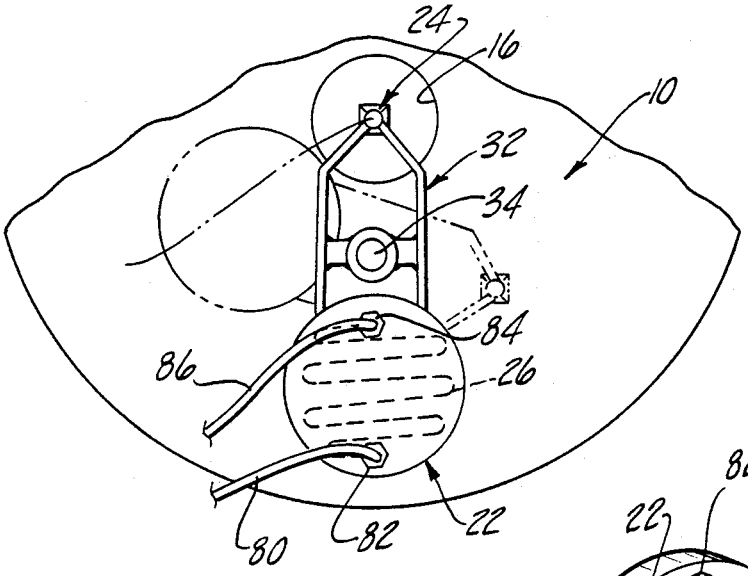
FIG. 3 is a fragmentary end view of the solar collector and transducer assembly.

While various dish constructions may be employed, one acceptable approach is disclosed in commonly assigned co-pending patent application Ser. Nos. 345,263, filed Feb. 2, 1982, U.S. Pat. No. 4,469,089, and 440,912, filed Nov. 12, 1982 abandoned, which are hereby incorporated by reference. As disclosed therein, dish 10 may comprise a composite sandwich of materials including an acrylic face covering to which a layer of reflected material such as aluminum is applied on the convex side thereof. A layer of foam resin or polyester reinforced with fiberglas is then applied to the backside of the metallization in order to render the dish self-supporting. The convex side of the dish may include other suitable support structure such as the strut network 14 shown in FIG. 2 to further provide rigidity for the dish.

In the embodiment shown in FIGS. 1–5, the central portion of the dish 10 includes an opening 16. An auxiliary reflector 18 is positioned at the focal point of dish 10 by way of suitable arms 20 extending from the outer portions of the dish. Reflector 18 serves to direct waves reflecting from dish 10 toward the focal point thereof back through the center 16 of the dish as illustrated by the arrows in FIG. 1. Pursuant to the present invention, means are provided for utilizing both the reflected solar energy and electromagnetic energy containing satellite communication data.

To this end, a solar collector 22 and electromagnetic transducer 24 are located on the convex side of dish 10. Solar collector 22 may be of a wide variety of constructions capable of absorbing solar energy and transferring it to another medium. In the illustrated example, solar collector 22 includes a maze of passageways 26 (FIG. 3) for carrying water or other fluid. Transducer 24 likewise can comprise a wide variety of suitable components. For receiving satellite communications, transducer 24 typically includes a feed horn 28 and an associated low noise amplifier (LNA) 30.

Figure 4:
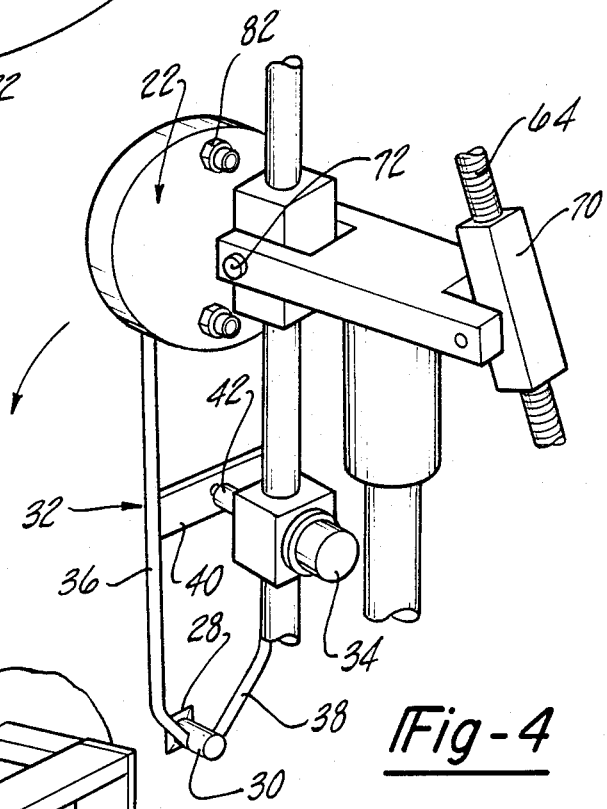
FIG. 4 is a perspective view similar to FIG. 3 and including portions of the dish support structure.

The preferred embodiment of the present invention employs some mechanism for moving the solar collector 22 and transducer 24 into a position for receiving the reflected waves. In the embodiment shown in FIGS. 1–4, this mechanism takes the form of an elongated rotating frame 32 pivotally connected to a suitable electrical motor 34. As best illustrated in FIG. 4, frame 32 employs a pair of arms 36, 38 whose opposite ends are connected to collector 22 and transducer 24. A cross bar 40 is connected to a transversely extending shaft 42 driven by motor 34. Actuation of motor 34 causes the frame 32 to pivot about shaft 42 rotating either collector 22 or transducer 24 into alignment with dish opening 16 as diagrammatically illustrated in FIG. 3.

Figure 5:
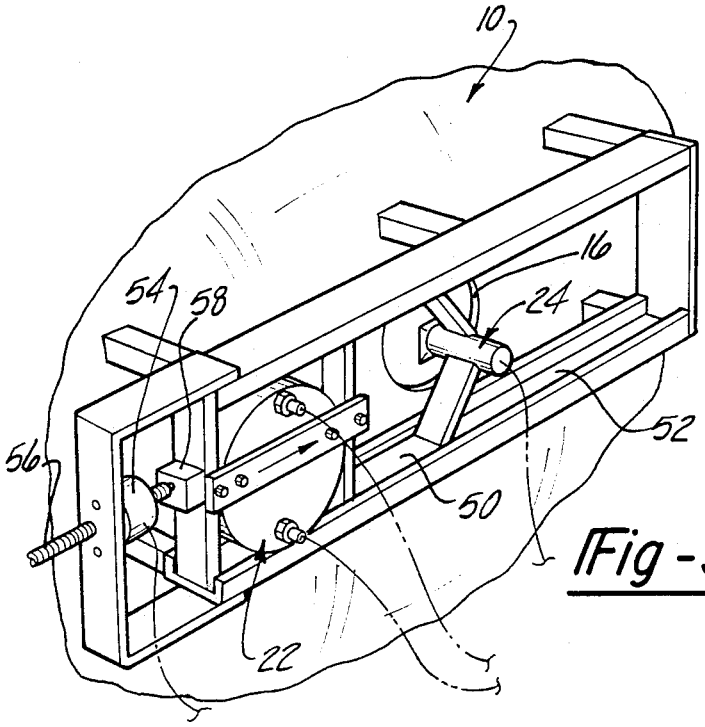
FIG. 5 is an alternative embodiment of a construction for moving the solar collector and transducer.

FIG. 5 illustrates an alternative mechanism for positioning collector 22 and transducer 24. As shown therein, collector 22 and transducer 24 are mounted on a slide 50 riding in an elongated track 52. In FIG. 5, the transducer 24 is shown aligned with dish opening 16. To move solar collector 22 into alignment, the slide 50 is moved rightwardly carrying collector 22 into proper position. The movement of slide 50 is advantageously accomplished by way of a screw drive arrangement employing a reversible electric motor 54, a screw 56 and a nut 58 connected to one end of slide 50. Rotation of screw 56 in one direction causes the slide 50 to move in a first direction whereas reversal of the screw rotation causes a corresponding reversal of the slide movement.

Various other mechanisms for appropriately positioning collector 22 and transducer 24 will become apparent to one skilled in the art. Similarly, numerous constructions for positioning dish 10 may be employed. In the example illustrated in FIGS. 1–3, a drive motor 60 coupled to post 62 serves to move the dish 10 in a generally horizontal direction or azimuth. Elevation of the dish is controlled by way of a threaded arm 64 coupled at one end to framework 66 via clevis 68 and at its intermediate portion to trunion 70. Movement of arm 64 causes the dish 10 to pivot about point 72 thereby controlling its elevation.

Figure 6:
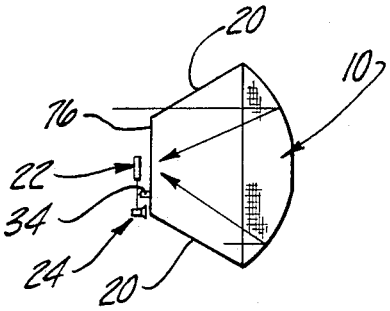
FIG. 6 is a side view of an alternative embodiment of this invention schematically showing the solar collector/transducer mounted in front of the dish.

FIG. 6 illustrates, in simplified form, an alternative embodiment of this invention. Instead of the collector 22 and transducer 24 being mounted rearwardly of dish 10 they are mounted in front of the dish. The same type of pivoting mechanism as shown in FIGS. 1–4 may be employed to rotate the collector 22 or transducer 24 into the focal point of dish 10. In such case, motor 34 would be connected to a suitable supporting structure 76 connected to or forming a part of struts 20.

During the daylight hours, the solar collector is positioned for receiving the reflected rays from the dish. The dish is moved so as to generally track the elevation and azimuth of the sun as it moves across the sky. Various automated tracking mechanisms are well within the skill of the ordinary practitioner. Fluid is then circulated through the collector 22. This may be accomplished by way of an elongated flexible hose 80 carrying water from a building to an inlet fitting 82 in the solar collector 22. The fluid flows through the maze of passageways 26 and absorbs the solar energy reflected from dish 10. The heated fluid passes out of outlet fitting 84 through hose 86 back into the building where it can be used for a wide variety of purposes.

While the front mounted embodiment of FIG. 6 may be employed, the rear mounted constructions shown in FIGS. 1–5 are particularly advantageous in that the dish shields the transducer 24 from solar energy. Consequently, the sensitive electronic components therein will not be adversely affected by the large concentration of heat reflected from the dish.

During the night time hours, the construction of the present invention may be used as an antenna for receiving satellite communications. In this mode of operation, the dish 10 is tilted into the appropriate position for receiving the desired satellite communication transmission. Transducer 24 is then moved into position to receive the radio frequency waves reflected from dish 10. In the embodiment of FIGS. 1–4 and 6, this is accomplished by energizing motor 34 to rotate transducer into the place previously occupied by the solar collector 22. In the embodiment of FIG. 5, motor 54 is actuated to rotate screw 56 and move the slide 50 carrying transducer 24 into the appropriate position. The microwave radio frequency transmissions are then fed by feed horn 28 into the LNA 30. LNA 30 operates to convert the very high frequencies the satellites use down to standard UHF frequencies. A coaxial cable 90 carries the down converted signals to receiver 92 which demodulates the signal and sends it to other preprocessing electronics so that the satellite communications can be displayed on a conventional television monitor.

From the foregoing it can be appreciated that the present invention provides a combination solar collector and satellite antenna at a relatively low cost by using the same dish to collect and concentrate both solar and electromagnetic energy. Various improvements and modifications of the embodiments described herein will become obvious to one skilled in the art. Therefore, while this invention has been described in connection with particular examples thereof, no limitation is intended thereby except as defined in the appended claims.

I claim:

1. A combination solar energy collector and satellite antenna apparatus comprising:

first means including a dish for reflecting incident energy to a predefined area;

second means for converting solar energy to thermal energy;

third means for receiving electromagnetic signals encoded with information; and fourth means for selectively moving the second or the third means to the predefined area whereby the same dish can be used as part of a solar energy converter and an antenna for receiving satellite communications.

2. The apparatus of claim 1 wherein said dish includes an opening in central portions thereof, and wherein said first means further includes an auxiliary reflector positioned at about the focal point of the dish, adapted to reflect energy from the dish through said opening; and wherein said second and third means are selectively movable into alignment with said opening on a convex side of the dish.

3. The apparatus of claim 1 wherein said fourth means comprises:

an elongated member having said second and third means connected to opposite ends thereof, and means for rotating said member to bring the second or third means into the predefined area.

4. The apparatus of claim 1 wherein said fourth means comprises:

a slide member movable in a track, said second and third means being mounted on spaced location on the slide, and means for moving the slide in the track to selectively position the second or third means at the predefined area.

5. The apparatus of claim 1 wherein said second means is connected to a fifth means for converting thermal energy into alternative utilizable forms of energy.

6. The apparatus of claim 1 wherein said third means is connected to a sixth means for detecting electromagnetic signals encoded with information.

7. The apparatus of claim 1 wherein said second means is connected to a fifth means for converting thermal energy into alternative utilizable energy and said third means is connected to a sixth means for detecting electromagnetic signals encoded with information.

8. A method comprising:

using a dish shaped reflector during daylight hours to concentrate solar energy onto a solar to thermal energy converting device;

using the same dish during times when not in use as a solar to thermal energy converter to collect radio frequency satellite communication signals and reflect those signals onto a feed horn/low amplifier assembly.

9. The method of claim 8 which further comprises the step of:

selectively moving the solar collector and feed horn/LNA assembly to a predefined area for selectively collecting thermal energy and receiving radio frequency signals, respectively, reflected from said dish.

10. The method of claim 8 which further comprises the steps of:

converting the thermal energy into useful energy forms and changing the information carried by the communication signals received into alternative forms of information.

11. Apparatus comprising:

a dish having a reflective coating on its concave surface for reflecting solar energy and radio frequency satellite communication signals to a first surface;

an auxiliary reflector positioned at the first surface for reflecting waves from the concave surface of the dish back through to a central opening in the dish;

a solar energy converter for producing thermal energy;

means connected to receive the absorbed thermal energy and to convert the thermal energy to a different form of energy;

an electromagnetic transducer including a feed horn/low noise amplifier (LNA) assembly;

means for detecting electromagnetic signals encoded with information;

means disposed on the convex side of the dish for selectively moving said solar energy converter and transducer into alignment with the opening in the dish such that the converter and transducer are shielded by the dish when not aligned with the opening, whereby said apparatus may be used as a combination thermal energy collector and converter and antenna for receiving satellite communications.

* * * * *